US005370086A

United States Patent [19]

Saujet et al.

[11] Patent Number: 5,370,086

[45] Date of Patent: Dec. 6, 1994

[54] HOT GAS RECOVERY BOILER

[75] Inventors: Jean-Francois Saujet, Asnieres; Djamel Daoud, Paris, both of France

[73] Assignee: Stein Industrie, Velizy-Villacoublay, France

[21] Appl. No.: 156,698

[22] Filed: Nov. 24, 1993

[30] Foreign Application Priority Data

Nov. 27, 1992 [FR] France ..... 92 14317

[51] Int. Cl.[5] ..... F22D 1/00

[52] U.S. Cl. ..... 122/7 R; 60/39.5; 122/470

[58] Field of Search ..... 122/7 R, 470, 420; 60/39.182, 39.5

[56] References Cited

U.S. PATENT DOCUMENTS

| | | | |
|---|---|---|---|
| 1,666,276 | 4/1928 | Weller | 122/7 R |
| 3,356,159 | 12/1967 | Csathy et al. | 122/7 R |
| 4,466,241 | 8/1984 | Inui et al. | 60/39.182 |
| 4,693,213 | 9/1987 | Yanai et al. | 122/7 R |

FOREIGN PATENT DOCUMENTS

| | | |
|---|---|---|
| 1065234 | 5/1954 | France . |
| 2374588 | 7/1978 | France . |
| 4038813 | 6/1992 | Germany . |

OTHER PUBLICATIONS

Oil And Gas Journal, vol. 83, No. 48, Dec. 1985, Tulsa, US, pp. 116–125; "Ganapathy: Heat-recovery boiler design for cogeneration".

BWK Brennstoff Warme Kraft, vol. 36, No. 12, Dec. 1983, Wurzburg, Germany, pp. 499–504; Gericke: "Abhitzedampf-Erzugersysteme: Bauelemente in verfahrenstechnischen Prozessen".

*Primary Examiner*—Edward G. Favors

*Attorney, Agent, or Firm*—Sughrue, Mion, Zinn, Macpeak & Seas

[57] ABSTRACT

The present invention relates to a hot gas recovery boiler comprising a substantially horizontal gas inlet duct, a gas deflection duct connected to the inlet duct and opening out into a generally vertical enclosure that contains a set of superposed and substantially horizontal heat exchange stages plus a flue gas exhaust duct at the top of the enclosure. At least one heat exchanger is disposed in the proximity of the outlet of said inlet duct.

7 Claims, 2 Drawing Sheets

HOT GAS RECOVERY BOILER

FIELD OF THE INVENTION

The present invention relates to a heat-recovery boiler that takes in hot gases, in particular from the outlet from a gas turbine.

More precisely, the invention relates to a hot gas heat-recovery boiler including a gas inlet duct extending generally horizontally, a gas deflection duct connected to the inlet duct and opening out to a substantially vertical enclosure that contains a set of superposed and substantially horizontal heat exchanger stages plus a flue gas exhaust duct at the top of the enclosure.

BACKGROUND OF THE INVENTION

The temperature of gas at the outlet from a gas turbine is very high, and at present may be as much as 650° C. The inlet and deflection ducts must therefore be designed to withstand such temperatures. Given their large size, they cannot be made entirely out of stainless steel because of the expansion problems that would result. They are therefore generally made of "warm casing" metal sheet constituted by a sheet of steel, a thermally insulating layer, and tiles of stainless steel organized in the form of scales. Thus, the steel sheet, in particular a sheet of E24 steel, is maintained at a temperature of about 320° C. In addition to being relatively complex to make up, such a sheet also poses problems of being relatively fragile.

OBJECTS OF THE INVENTION

The invention seeks to solve these problems, and to do this, at least one heat exchanger is placed in the proximity of the outlet of said inlet duct so as to reduce the temperature of the gas at the outlet from said heat exchanger, said heat exchanger being inclined and its outlet surface facing towards the inlet of the enclosure.

Thus, the duct in which temperature is very high, e.g. about 650° C., is limited to the smaller inlet duct. In the deflection duct, the temperature is lower, e.g. 560° C., thereby making it possible to avoid the need for insulation constraints in said duct, and particularly thereby no longer requiring "warm casing" sheet.

In addition, by using this disposition, the flow of gas downstream from the heat exchanger is improved because of the head loss generated by the gas passing between the tubes of the heat exchanger, and by the gases being channeled through the heat exchanger.

Because of the inclination of the heat exchanger and the disposition taken up by its antivibration baffle, the distribution of the gas flow downstream from the heat exchanger and prior to entering the enclosure of the boiler is likewise improved. The heat exchanger thus constitutes a system for making the flow of gas more uniform.

This inclined disposition also makes it possible to reduce the height of the boiler.

Since the temperature is reduced therein, the deflection duct can be made of steel, preferably steel having 2.25% chromium.

Since its size is small, the inlet duct may be made of stainless steel.

Advantageously, the outlet surface of the inlet duct and the inlet surface of the deflection duct are both inclined, facing towards the inlet of the enclosure and interconnected by means of an expansion joint.

Having the expansion joint inclined in this way ensures that it is not subjected to pure shear under the effect of vertical expansion of the boiler supported at its top end, but is subjected to combined compression and shear which makes it more reliable.

Under such circumstances, it is preferable for the heat exchanger to be disposed immediately upstream from the expansion joint.

The heat exchanger preferably constitutes, at least in part, a bottom heat exchange stage of the boiler.

BRIEF DESCRIPTION OF THE DRAWINGS

The invention is described below with reference to the figures that merely show a preferred embodiment of the invention.

MORE DETAILED DESCRIPTION

The recovery boiler shown is disposed at the outlet of a gas turbine and comprises in conventional manner a gas inlet duct 1 that extends generally horizontally, a gas deflection duct 2 connected to the preceding duct 1, and opening out into an enclosure 3 that extends substantially vertically and that contains a set of substantially horizontal heat exchange stages that are superposed plus an exhaust duct 4 for the flue gases disposed at the top of the enclosure 3.

Figure 2:
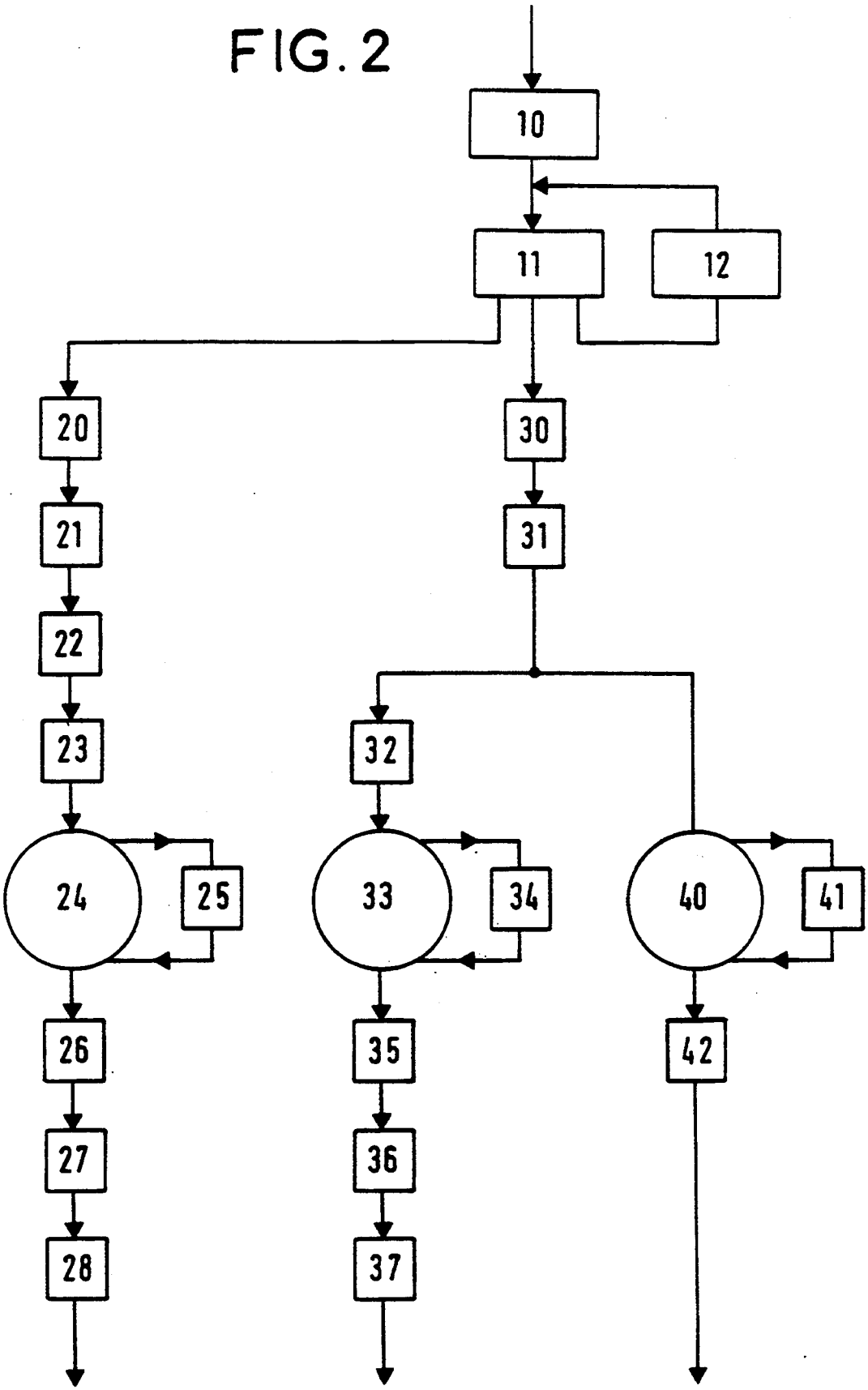
FIG. 2 is a diagram of the water-stream circuit of the heat exchange stages for a recovery boiler operating at three pressures with reheating and with a combined gas turbine and steam turbine cycle.

Using the rotation: HP for high pressure; IP for intermediate pressure; LP for low pressure; HT for high temperature; IT for intermediate temperature; and LT for low temperature; FIG. 2 is a diagram showing:

a condensing preheater 10;

a feed tank 11;

a de-aerating evaporator 12 in parallel with the tank;

an HP feed pump 20 at the outlet from the tank 11;

an IP/LP feed pump 30 at the outlet from the tank 11;

HP1, HP2, and HP3 economizers 21, 22, and 23 in series at the outlet from the pump 20;

an HP tank 24;

an HP evaporator 25 in parallel with the tank 24;

LT, IT, and HT superheaters 26, 27, and 28 in series, with steam at the outlet therefrom being delivered to the HP portion of a steam turbine;

an IP1/LP economizer 31 at the outlet from the pump 30;

an IP2 economizer 32 at the outlet from the economizer 31;

an IP tank 33;

an IP evaporator 34 in parallel with the tank 33;

an IP superheater 35;

an LT reheater 36;

an HT reheater 37 with the steam at the outlet therefrom being applied to the IP portion of a steam turbine;

an LP tank 40 at the outlet from the economizer 31;

an LP evaporator 41 in parallel with the tank 40; and an LP superheater 42 with the steam at the outlet therefrom being applied to the LP portion of a steam turbine.

Figure 1:
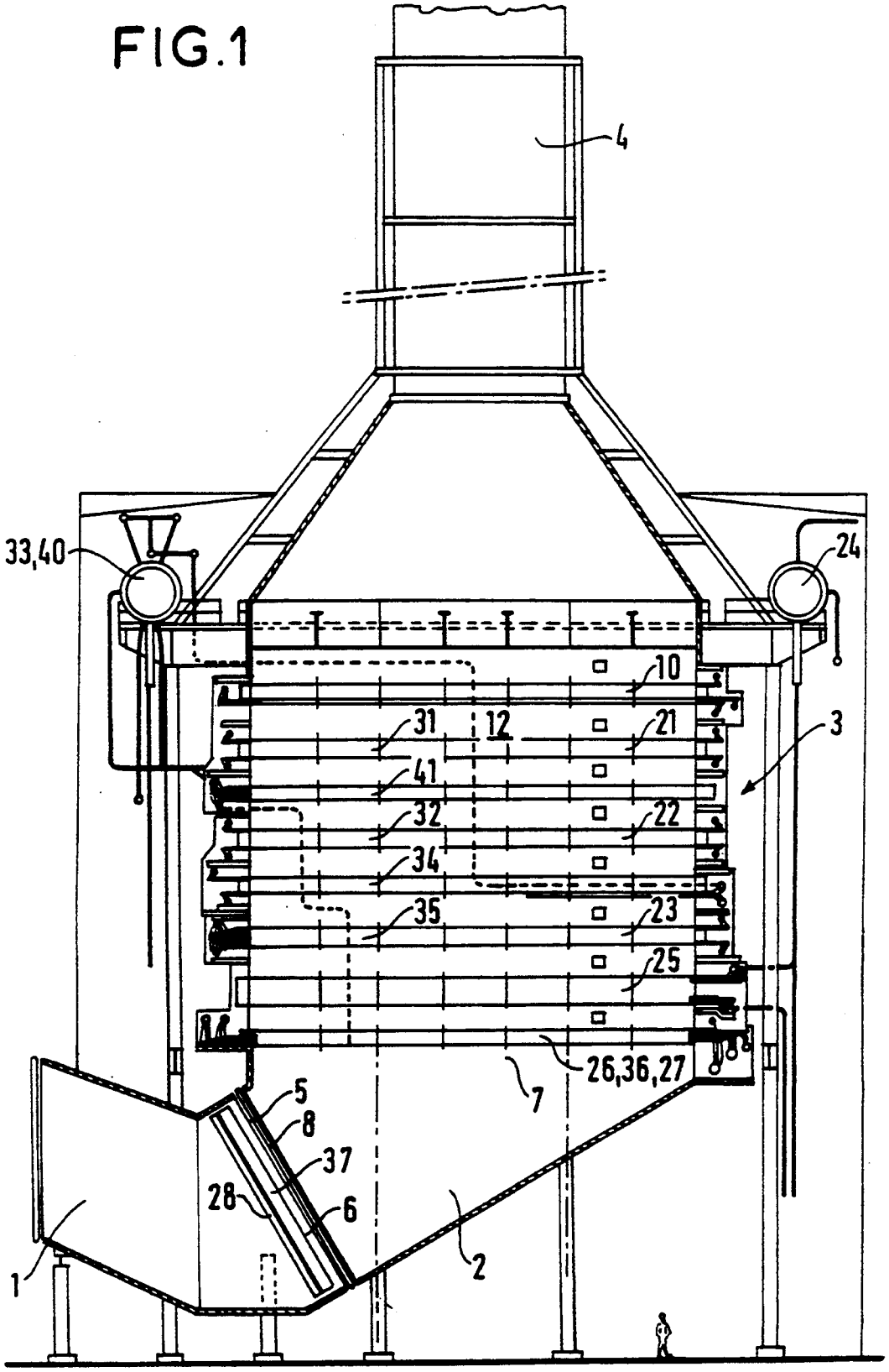
FIG. 1 is a vertical section view through a boiler of the invention.

With reference to FIG. 1, at least one heat exchanger 5 is disposed in the proximity of the outlet of said inlet duct 1. It is inclined, with its outlet surface 6 facing towards the inlet 7 of the enclosure 3.

The deflection duct 2 is made of steel, preferably steel having 2.25%, chromium, and the inlet duct 1 is made of stainless steel. The outlet surface of the inlet duct 1 and the inlet surface of the deflection duct 2 are inclined, both facing towards the inlet of the enclosure 3 and they are connected together by an expansion joint 8, with the heat exchanger 6 being located immediately upstream from the expansion joint 8.

The heat exchanger 6 constitutes at least a portion of a bottom heat exchange stage of the boiler. In the example described, the heat exchanger 6 comprises two heat exchangers, being constituted by the HT superheater 28 and the HT reheater 37. In the prior art, the HT superheater 28 and the HT reheater 37 are disposed with the other heat exchange stages within the enclosure 3 of the boiler. In this particular embodiment, the invention consists in transferring at least one of said items to the outlet of the inlet duct 1.

We claim:

1. A hot gas heat-recovery boiler including a gas inlet duct extending generally horizontally, a gas deflection duct connected to the inlet duct and opening out to a substantially vertically enclosure that contains a set of superposed and substantially horizontal heat exchanger stages plus a flue gas exhaust duct at the top of the enclosure, wherein at least one heat exchanger is disposed in the proximity of the outlet of said inlet duct, said heat exchanger being inclined and its outlet surface facing towards the inlet of the enclosure.

2. A boiler according to claim 1, wherein the deflection duct is made of steel.

3. A boiler according to claim 2, wherein the deflection duct is made of steel having 2.25%, chromium.

4. A boiler according to claim 1, wherein the inlet duct is made of stainless steel.

5. A boiler according to claim 1, wherein the outlet surface of the inlet duct and the inlet surface of the deflection duct are inclined, both facing towards the inlet of the enclosure and connected together by an expansion joint.

6. A boiler according to claim 5, wherein the heat exchanger is disposed immediately upstream of the expansion joint.

7. A boiler according to claim 1, wherein the heat exchanger constitutes at least a portion of a bottom heat exchange stage of the boiler.

* * * * *